United States Patent [19]

Stillman et al.

[11] 4,397,793

[45] Aug. 9, 1983

[54] CONFINED VORTEX COOLING TOWER

[76] Inventors: Gerald I. Stillman, 26 Claremont Ave., Maplewood, N.J. 07040; Rudolf A. Wiley, 63 Brookview Ave., Delmar, N.Y. 12054

[21] Appl. No.: 96,063

[22] Filed: Nov. 20, 1979

Related U.S. Application Data

[63] Continuation-in-part of Ser. No. 903,102, Jun. 8, 1978, abandoned.

[51] Int. Cl.[3] ..... F28C 1/04

[52] U.S. Cl. ..... 261/30; 261/DIG. 11; 261/DIG. 77; 261/109

[58] Field of Search ..... 261/112, 30, DIG. 11, 261/DIG. 77, 109; 165/DIG. 1; 110/215; 98/58; 415/2 R, 3

[56] References Cited

U.S. PATENT DOCUMENTS

| | | | |
|---|---|---|---|
| 1,627,713 | 5/1927 | Seymour | 261/DIG. 11 |
| 3,243,166 | 3/1966 | Osenga et al. | 261/DIG. 11 |
| 3,385,197 | 5/1968 | Greber | 261/DIG. 11 |
| 3,498,590 | 3/1970 | Furlong | 261/DIG. 77 |
| 3,749,379 | 7/1973 | Brown | 261/DIG. 11 |
| 3,846,519 | 11/1974 | Spangemacher | 261/DIG. 77 |
| 3,933,196 | 1/1976 | Heller et al. | 261/DIG. 11 |
| 3,965,672 | 6/1976 | Stephens | 261/DIG. 77 |
| 4,031,173 | 6/1977 | Rogers | 261/DIG. 11 |
| 4,142,822 | 3/1979 | Herbert et al. | 415/2 R |

FOREIGN PATENT DOCUMENTS

| | | | |
|---|---|---|---|
| 1943067 | 3/1971 | Fed. Rep. of Germany | 261/DIG. 77 |
| 418320 | 10/1934 | United Kingdom | 261/DIG. 11 |
| 525702 | 9/1940 | United Kingdom | 261/DIG. 77 |
| 629368 | 9/1949 | United Kingdom | 261/DIG. 11 |
| 907852 | 10/1962 | United Kingdom | 261/DIG. 77 |

*Primary Examiner*—Gregory N. Clements
*Attorney, Agent, or Firm*—Vogt & O'Donnell

[57] ABSTRACT

Means for increasing the efficiency of effluent discharge from a cooling tower or other stack by means of introducing gaseous fluid streams through at least one or more vertical slots positioned about the periphery of a chimney of said tower or stack wherein said slots are capable of directing said fluid streams tangentially within the periphery of said chimney to create a vortex within said chimney. Each of said slots extend at least a portion of the height of said chimney, and preferably extends from above a fill at the base of said chimney to approximately the mouth of said chimney. Means are provided for introducing cooling gaseous fluid streams into and through said fill to a cavity within said fill which also contains heat transfer or other effluent constituent removal surfaces or passages or other means to provide heat or other effluent constituent dissipation. The upper limit of said cavity is bounded by a floor, which defines the demarcation between said chimney and said fill. An orifice, through said floor, is preferably centrally positioned with respect to the central vertical axis of said chimney. The aforesaid tangentially directed gaseous fluid streams create a vortex within said chimney, such that a low pressure core is created to increase the momentum of the heat dissipating cooling gaseous fluid streams in said fill cavity and accelerate said cooling streams and entrain said cooling streams through said orifice to within said chimney to be exhausted by the aid of said vortex from the mouth thereof.

14 Claims, 4 Drawing Figures

CONFINED VORTEX COOLING TOWER

CROSS REFERENCE TO RELATED CASE

This application is a continuation-in-part of U.S. patent application Ser. No. 903,102, filed June 8, 1978 and now abandoned.

BACKGROUND OF THE INVENTION

1. Field of the Invention

The present invention relates to effluent removal from towers and stacks and particularly to heat removal from cooling towers. Gaseous fluid streams are selectively directed by vertical slot inlet and control means to produce a vortex flow regime within a chimney of said tower or stack to entrain and accelerate gaseous fluid streams flowing therein through an orifice from within a lower cavity portion. The invention provides heat or other effluent constituent removal such as heat transfer from a cooling fluid and removal of pollutants when embodied such as in a natural draft cooling tower which is either of the nature of a wet or dry system.

2. Description of the Prior Art

Utilization of fluid streams, usually ambient or forced air, to provide a means for removing heat or, more particularly, for cooling a condenser, or other heat exchanger, has been described in the art. U.S. Pat. No. 1,627,713 to Seymore (1927) discloses directing air, preferably tangentially, into the base of a cooling tower above the coolant to create rotative movement and thus more efficient cooling. In addition, Seymore discloses that exhaust means may be provided upon the walls of the tower to discharge at least a portion of the effluent axially.

British Specification No. 418,320 to Mouchel et al. (1934) depicts a cooling tower, which incorporates apertures in the walls to create a substantially horizontal flow of air and has for a purpose the reduction of precipitation in the surrounding atmosphere. It is stated that this embodiment, however, reduces the cooling efficiency of the tower.

Mouchel et al. also suggested incorporating nozzles within said apertures, to distribute air well inside the wall. Subsequently, Mouchel et al., in British Specification No. 629,368 (1949), described the nozzles of British Specification No. 418,320 as being arranged within the tower near its mouth and further disclosed the introduction of air, of suitable temperature, towards or away from the axis of the tower.

To reduce the dimensions and environmental impact of stacks or cooling towers, Hosking et al., in British Specification No. 525,702 (1940), suggested submerging the tower below ground level and introducing air through the base of the tower to create a kinetic effect in combination with the effluent ejected from a stack which is axially and centrally positioned. The stack extends upward and terminates at a restricted neck section of the tower. Alternative exit holes were provided in the tower sidewalls below the mouth of the stack.

Within the last decade, with the advent of large electric generating plants, which range in output from 600 megawatts (MW) for fossil-burning plants to 1,200 MW for nuclear plants and which have large cooling requirements associated therewith, and with the advent of environmental constraints, mechanical and natural draft cooling towers have become a primary means of cooling power plant condensers. The dimensions of natural draft cooling towers, which are associated with and result from the need to obtain adequate cooling capacity, may require, for example, a base diameter of 400 feet and a height of about 500 feet. The dimensions of such towers have become important factors in siting such fossil fuel and nuclear plants.

As previously stated, plants of this size category require large amounts of cooling capacity by means of condenser cooling water. A 1,000 MW fossil fuel plant, for example, may require approximately, 500,000 gallons per minute (gpm) of cooling water, while a similarly sized nuclear plant may require 750,000 gpm. Such quantities of water withdrawal from a body of water, accompanied by the heated water discharge, can have significant local effects on the biota of almost any river or lake near which the plant may be sited. Environmental regulations have been promulgated which have resulted in the use of evaporative towers, commonly known as wet cooling towers, which are of the natural draft or mechanical draft type. These towers require approximately one-fiftieth the amount of water withdrawal from a body of water as is required by an open-cycle type of cooling means for power plant condensers.

Mechanical draft cooling towers are much shorter than natural draft towers. Such towers are approximately 60–70 feet high but occupy significantly more land area in order to provide the same amount of cooling. Large amounts of energy are required to drive fans which provide the draft for the evaporative action. Further, the resultant effective height of the vapor plume from a mechanical draft tower is closer to ground level than that from a natural draft tower and consequently presents the possibility of ground fogging and icing which is frequently unacceptable.

In an effort, therefore, to reduce electric power consumption, to reduce noise and to reduce operation and maintenance costs associated with mechanical draft cooling towers, power plant designers have, in many cases, turned to natural draft cooling towers which, at present, provide cooling almost exclusively by evaporative means. The evaporative process involves the use of atmospheric cooling air which passes through heat transfer passages in the fill below the chimney portion of the structure and which entrains a small fraction of the condenser circulating water which has evaporated. The remainder of the circulating condenser water is thereby cooled. The warmed atmospheric air together with the entrained evaporated circulating condenser water rise, because of thermal buoyancy, until being discharged from the mouth of the chimney. As has been previously stated, to achieve adequate movement of this moist air mass within the tower, a conventional natural draft tower for a 1,000 MW plant, for example, may require a base diameter of about 400 feet and a height of about 500 feet. The size of the resulting structure may be considered to be a severe visual impact which is further compounded when there are several plants at a given site, each with its own cooling tower.

British Specification No. 907,852 to National Research Development Corporation (1962), describes an effort to increase plume discharge height from a stack. Pipes are arranged about the outer circumference of the stack mouth to deliver compressed air, which is directed upwardly. The embodiment contemplates operation with respect to wind velocity and direction to prevent depression of the plume below the top of the stack.

U.S. Pat. No. 3,498,590 to Furlong (1970) discloses the introduction of air, about the periphery of the lower portion of a tower, whereby the air so directed has a substantial direction parallel to the circumferential direction of the periphery as guided by partitions. It has, as an object, the direction of the gas in a spiral flow about the coolant sections by means of the partitions.

Spangemacher, in U.S. Pat. No. 3,846,519 (1974), introduces, within the cooling section, dry warm air in a direction opposite to the flow of water, which is acting as a means of coolant, to achieve more efficient cooling. Brown, in U.S. Pat. No. 3,749,379 (1973), found that by increasing the cross-sectional area of the exhaust port, in conjunction with auxiliary fans within the tower sidewalls, a substantial increase in the height of the plume could be achieved.

Of further interest are Greber, U.S. Pat. No. 3,385,197 (1973), and Stephens, U.S. Pat. No. 3,965,672 (1976). Greber uses a roof, or wind ejector, over the mouth of the tower to increase the draft of the tower. Stephens introduces air tangentially, which air is upwardly directed into the tower through the sidewalls, to reduce the necessity of wind ejectors which are embodied as roofs. Stephens allows ambient air to enter the tower base through curved slots, which requires that the tower be shaped in an L-shape with a well-rounded corner so the wind is accelerated up the sidewalls of the tower.

Rogers, U.S. Pat. No. 4,031,173 (1977), discloses a means for the generation of power and for discharging air through nozzles arrayed on the inside walls at the throat of the tower to augment and enhance the natural draft within a tower.

Finally, in U.S. Pat. No. 4,070,131 to Yen, an embodiment designed to provide means for driving a wind turbine generator, by means of the tangential admission of air is disclosed. The driving air force is introduced through and directed by means of vertically extending vanes which define a tower-like structure, to create a vortex flow, which draws ambient air into the bottom of the structure, to drive a horizontal turbine. A spiral configuration to create the vortex flow is also disclosed.

The present invention provides means for significantly reducing, for example, both the height and diameter of natural draft evaporative or dry cooling towers, for a particular cooling capacity, as compared to conventional natural draft evaporative or dry towers while retaining, and, at times increasing, the effective height of the vapor plume, in the case of evaporative towers. In the case of any tower or other stack, the objectives may be obtained by means of the creation of a stable confined effluent entraining vortex, as contemplated by the present invention. Similarly, a cooling tower of a given size, which uses the teachings of this invention, will have a significantly increased cooling capability compared to a comparably sized conventional cooling tower which does not use these teachings. If forced gaseous fluid streams, which may contain flue gas, are utilized as an auxiliary means to produce the confined vortex, the present invention may result in further benefits by providing the means for reduction of removal efficiency requirements for precipitators and sulfur dioxide scrubbers which are used for cleaning the flue gas from fossil fuel plants. It may provide more effective tower drift removal, elimination of smoke-stack structures and the elimination of reheat requirements for the gases emanating from wet process scrubbers. Furthermore, by adopting the teachings of the present invention, operating costs and maintenance costs may be decreased because of reduction of auxiliary equipment currently utilized in existing facilities. Those and other features and advantages are set forth more fully hereinafter in the following Summary of the Invention.

SUMMARY OF THE INVENTION

The present invention augments and enhances the mass flow of gaseous fluid streams in a cooling tower or other effluent removal stack, particularly in an upward direction, by means of a vortex which is created and confined within the chimney of the tower or stack. The vortex preferably is controlled, stable, and not in communication with the walls of the chimney. The walls of the chimney may somewhat aid in directing the formation of the vortex, but it is preferred that the walls only passively confine the vortex. Such confined vortex augments an upward draft effluent flow which enters the chimney from a cavity in the fill and which is entrained by the vortex through an orifice in a floor of the tower. This entrainment is caused by the creation of a low pressure core above the tower floor orifice. The vortex increases the entraining action of the low pressure core and the axial momentum of effluent containing gaseous fluid streams thus enhancing or augmenting the axial upward motion of the mass of said effluent containing gaseous fluid streams, propelling and ultimately expelling the same through the open mouth of the tower or other stack. In the case of a cooling tower, such effluent containing gaseous fluid streams will consist essentially of cooling gaseous fluid streams, introduced into said fill cavity, to which heat has been transferred.

In accordance with the present invention, in the tower structure, above the fill, the tower chimney may be hyperbolic or it may be tubular or it may be of spiral configuration. At least one gaseous fluid stream is introduced through the walls of the chimney structure tangentially, with respect to the said chimney walls, by means of at least one vertical slot, extending for substantially the height of said chimney. The fluid streams so introduced may be ambient air, or forced air, or flue gas effluent from a power plant, or a combination thereof. Auxiliary means may be utilized to introduce the forced air or flue gas effluent through said vertical slot or slots.

Located in the floor above the fill, preferably aligned with the central vertical axis of said tower chimney, is an orifice through which the effluent containing gaseous fluid streams are induced to flow into the chimney after being introduced to a cavity, conduits or other passages through said fill of said tower structure. The orifice permits the low pressure core of said confined vortex to entrain gaseous fluid flow from said fill cavity thus enhancing the flow regime and transfer capability of said effluent transfer or removal gaseous fluid streams, such as cooling gaseous fluid streams in a cooling tower, within said fill cavity. Specifically, the confined vortex core and resulting augmentation of gaseous fluid flow within said fill cavity produce a significantly accelerated axial flow field within the tower structure creating an upward rush of the combined fluid flows which enhance the cooling, for example, of hot condenser circulating water or other coolant moving through heat transfer embodiments in the fill at the base of a wet or dry tower. The coolant preferably circulates within the cavity relative to the vicinity of the orifice. It should be noted, particularly for dry cooling towers, that coolant conduits may be also located or positioned within the interior of the chimney of said tower structure. It will be appreciated that the mass flow of any effluent containing gaseous fluid, such as for example, flue gases in a stack, will similarly be enhanced. To further augment the induction of fluid flow into the tower, the orifice lip may be of a venturi shape or configuration and the orifice may be of an adjustable diameter. The orifice may also be bounded by an iris type structure which may control orifice size.

It will be further appreciated that a tower having the aforementioned spiral type of configuration, may have only one slot whereby said slot is extended by confining sidewalls which circularly, rather than tangentially, direct a gaseous fluid flow towards the central axis of the chimney and the inner chimney core. The chimney sidewalls may be tapered or be narrowed appropriately at either the outer or inner extent of the slot to augment the velocity and flow regime as desired, as long as the geometrical configuration of the chimney sidewalls are such that the fluid flow is directed to form an axial vortex.

In a tower having at least one tower wall slot, and in those having a plurality of tower wall slots, the chimney wall slots may be slanted or beveled, or preferably may be aerodynamically formed. Such slots may be adjustable if desired, to provide that the fluid stream introduced at any point therethrough will enter the chimney structure approximately tangentially, with regard to the chimney walls. Further, controllable vanes may be positioned within said slots. It is also contemplated that the chimney structure could be characterized or defined by fixed or adjustable vanes.

Analysis of the vortex fluid flow provides an indication of the dimensional relationships which will sustain a stable confined vortex with a desired flow within the cooling tower. These and other features are more particularly exemplified by the following Description of the Preferred Embodiment and Example.

DESCRIPTION OF THE DRAWINGS AND PREFERRED EMBODIMENT

Figure 1:
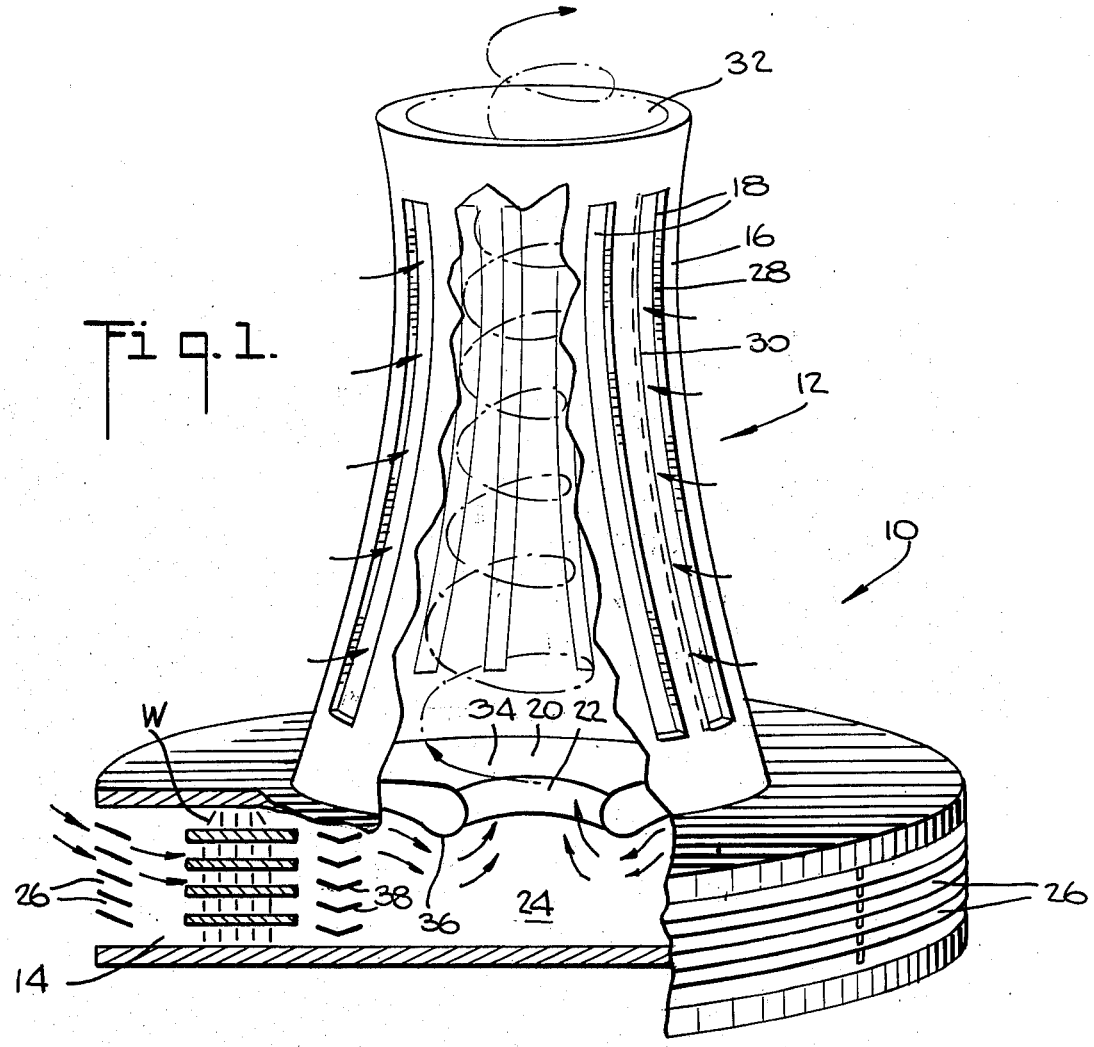
FIG. 1 illustrates a sectional vertical elevation view of a cooling tower illustrating the means of creating a confined vortex by means of the introduction and direction of gaseous fluid streams tangentially into the chimney by means of vertically extending slots to entrain and accelerate the flow of cooling gaseous fluid streams from a lower cavity in the fill through an orifice in the floor of the tower.

Referring now to the drawings and in particular to FIG. 1, a sectional vertical view of an effluent discharge means of the present invention such as cooling tower 10, embodying the teachings of the present invention, is illustrated. At the base of tower chimney 12 is fill 14. Tower chimney 12 is embodied by sidewalls 16 which are positioned and extend upwardly. Incorporated within sidewalls 16 are vertically extending slots, collectively numbered 18, which extend from above fill 14 for substantially the height of sidewalls 16. It will be appreciated that effluent discharge stacks of other types may employ the teachings of the present invention wherein it is understood that the effluent to be dissipated enters said stack at or near its base and is discharged by means of a chimney.

Above fill 14, and located within cooling tower 10, is cooling tower floor 20 which has an orifice 22 extending therethrough to connect with cavity 24 surrounded and encompassed by said fill.

Means, such as passageways 26, are provided to admit and supply cooling gaseous fluid, preferably atmospheric air, into said fill cavity 24. Encompassed by the fill, as is known in the art are heat transfer surfaces or passages or other means not specifically illustrated herein, for cooling or accepting the transfer of heat from water circulating in the heat transfer embodiments in fill cavity 24. The cooling gaseous fluids from passageways 26 and cavity 24, after removing heat from the coolant, enter cooling tower chimney 12 by means of orifice 22.

Slots 18 extend through chimney sidewall portions 16 and are defined by sidewall edges 28 and 30, which are preferably aerodynamically shaped with respect to perpendicular vertical planes through the vertical axis of cooling tower 10, as more specifically illustrated in FIGS. 2 and 3 hereinafter. The slots direct a tangential flow of gaseous fluid streams with respect to the inner surfaces of sidewalls 16 of chimney 12.

The tangentially induced or directed air creates a vortex about the central axis of chimney 12 and creates a low pressure core above orifice 22 which draws the effluent containing gaseous fluid stream mass from cavity 24 upward into the vortex to exit through chimney mouth 32.

The diameter of orifice 22 through floor 20, centrally disposed through said floor 20 with regard to the central vertical axis of said chimney 12, is smaller than the diameter of said chimney sidewalls 16 at the point at which said sidewall communicates with fill 14. The size and positioning of orifice 22, which is thereby concentrically aligned in series with chimney mouth 32, is more fully explained in the Example.

To further augment the flow of the gaseous fluid stream through orifice 22 and to achieve drift elimination, upper lip 34 and lower lip 36 of orifice 22 may be aerodynamically formed to enhance the fluid stream flow from cavity 24 into chimney 12 through orifice 22.

As illustrated in FIG. 1, orifice 22 may be comprised of and formed in the shape of two venturis in series, lower venturi lip portion 36 causing approximately 270° turn of said effluent containing gaseous fluid stream mass. Such turning of the effluent gaseous fluid stream mass will cause centrifugal forces to expel water particles, known as drift therefrom. Of course, it may be desired that only one surface lip of orifice 22 be shaped as a venturi, in which case it is preferred that the lower lip be so shaped for the reason stated above. The angle of said lips may also be varied to form a shape such as a diffuser augmentor or to form other augmentation shape. Certain shapes, such as said aforementioned two venturis, will enhance the action of chevron mist eliminators 38, utilized in the art to minimize drift.

Figure 2:
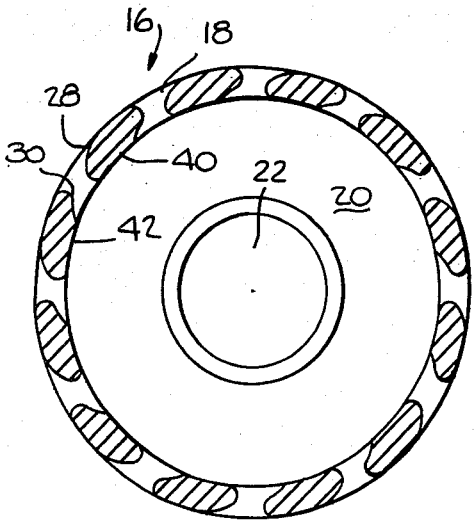
FIG. 2 illustrates a sectional top view of the chimney of FIG. 1 and the slots therein.

FIG. 2 illustrates a sectional top view of chimney sidewall 16 having sidewall portions 40 and 42 which define vertical slot 18 to create the aforesaid tangential flow regime within said chimney. Edge 28 of sidewall portion 40 and edge 30 of sidewall portion 42 are complementarily aerodynamically shaped to direct the flow regime for creation of the desired vortex.

Figure 3:
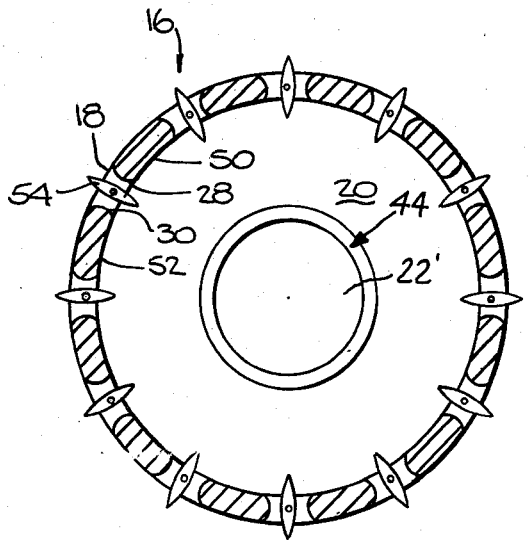
FIG. 3 illustrates a sectional top view of an alternative embodiment of the chimney of FIG. 1 and the slots therein with further means of directing said fluid streams.

FIG. 3 illustrates a top sectional view of an alternative embodiment of the invention including chimney sidewall 16 having sidewall portions 50 and 52 which define vertical slot 18. Aerodynamically shaped pivotable vane 54 is positioned within said vertical slot 18 between sidewall edges 28 and 30. Sidewall edges 56 and 58 will be shaped complementarily with the shape of said pivotable vane.

Auxiliary means may be desired for the introduction of the tangentially directed gaseous fluid streams, or may be required, where ambient wind speed is insufficient to force air through said tangential slots 16 to create said vortex. Ambient wind is preferably utilized to form the vortex. To compensate for lack of balance of input about the circumference of the tower chimney where the chimney has a plurality of slots, pivotable or other controllable slot vanes 54 may be desired which open or close, wholly or partially in various combinations, to maintain the vortex and to prevent leakage from the chimney sidewalls. The embodiment illustrated in FIG. 3 has an iris-type structure 44 bounding the orifice 22'.

Figure 4:
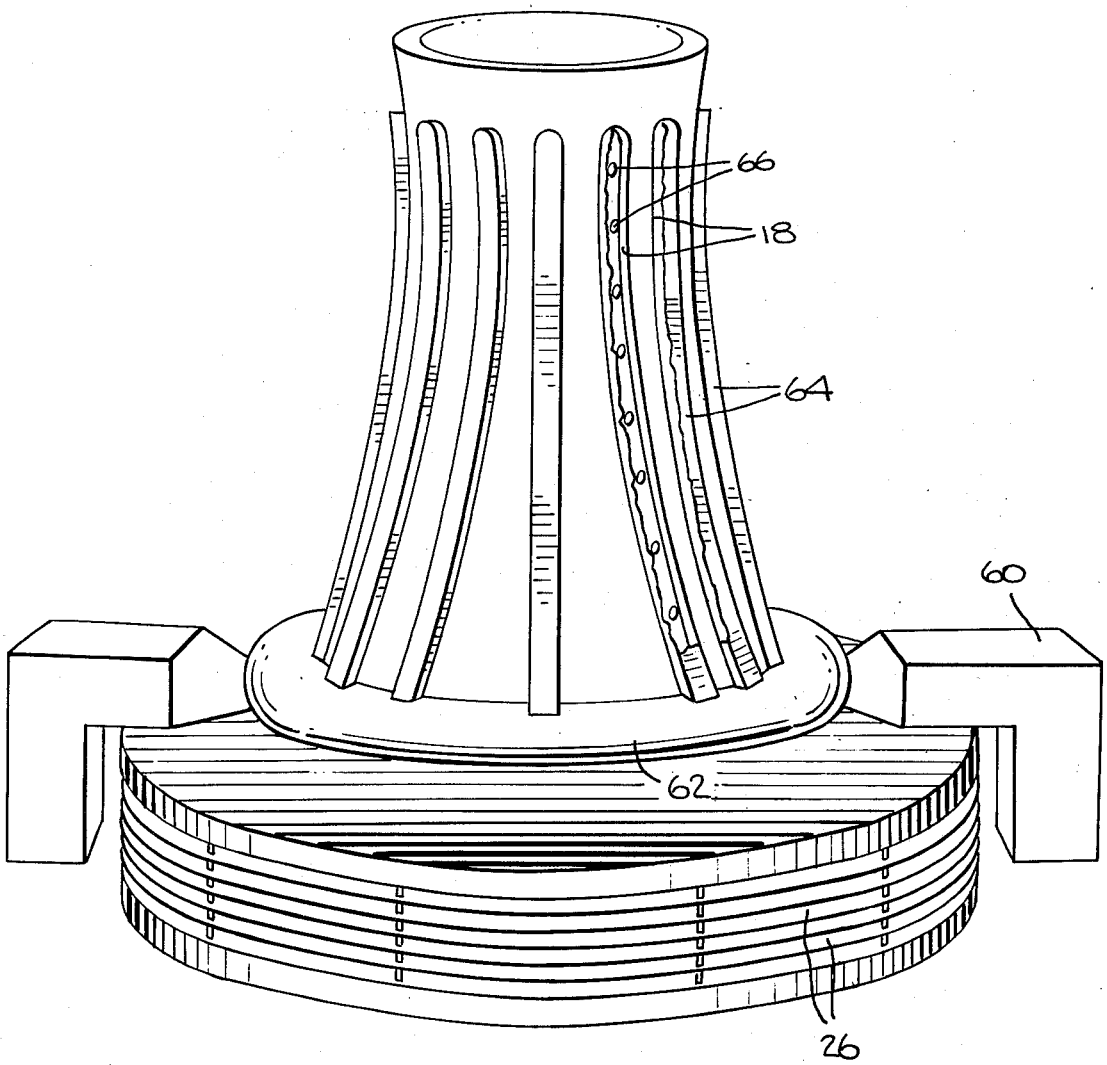
FIG. 4 illustrates a sectional vertical elevation view of the tower of FIG. 1 employing auxiliary means to introduce forced gaseous fluid streams tangentially within said tower.

FIG. 4 illustrates a tower 10 utilizing the teachings of the present invention and auxiliary means to supply forced gaseous fluid streams to augment the creation of or the efficient control of the vortex. It will be appreciated that forced air streams may be supplied by individual fans or other similarly appropriate means, positioned relative to chimney sidewalls 16 and slots 18, which will direct the fluid streams through said tangential slots, although not specifically illustrated.

Alternatively, as seen in FIG. 4, or in combination with such aforementioned auxiliary means, as secondary directional means, forced gaseous fluid streams can be supplied by a forced draft fan supplying the same through duct 60 via a plenum chamber 62 which may encircle cooling tower 10 at or above fill 14. Ducts 64, which enclose and encompass slots 18 serve as conduits to provide said forced gaseous fluid streams to and through said slots 18. Nozzles 66, or other directional means, may be utilized to properly distribute the forced gaseous fluid streams to create said vortex such that the forced fluid streams traveling through ducts 64 are translated circumferentially and thereafter are directed tangentially into said chimney to create and maintain the vortex. Stack gas or other gaseous effluent may be utilized, if available, to be blown into said plenum chamber 62 and said ducts 64 to provide at least a portion of said forced gaseous fluid streams.

For fossil-fired power plants, the flue gas effluent comprises about 10% of the tangential volumetric flow needed to create the desired vortex for the given mass rate of air flow. The use of flue gas is desirable because it supplements the natural wind and/or decreases the fan-driven air requirements; it eliminates the need for a smokestack; and it reduces the pollutant removal efficiency requirements for precipitators and scrubbers upstream of the cooling tower which now functions as a stack as well.

EXAMPLE

The following example illustrates the theoretical dimensional and physical relationships of the tower to create a desired vortex. The Navier-Stokes equations describe a vortex formed in the chimney whereby the velocity of the air mass within the chimney structure is accelerated parallel to the vortex axis by the pressure differential within the vortex.

It can be seen that the vortex core will be equal in size and coincident with the area of the orifice, and thus will provide maximum axial induction of fluid streams through the orifice. It can also be seen that the vortex core axis and the orifice axis will be coincident. It can be further seen that the radius ($r_c$) of the vortex core depends on the height (H) and radius (R) of the cooling tower and the cumulative frontal aperture angle ($\alpha$) of the peripheral slots which tangentially admit ambient air. Specifically, it can be shown that the equation of state of the vortex is:

$$(H\alpha)r_c^4+(AR^2)r_c^3+(BHR^2\alpha)r_c^2(CH^2-R^2\alpha^2)r_c+(DH^3R^2\alpha^3)=0$$

where the parameters A, B, C and D are constants. In calculating the values of the constants, conservation of flow and enthalpy should be taken into account.

The quartic equation implies that the axis of the orifice must coincide with the axis of the vortex core. The orifice diameter can be determined from this equation when the height and diameter of the chimney and frontal aperture angle are known.

The volumetric flow rate (Q) of gaseous fluid flowing axially through the orifice is:

$$Q=A'Rr_cV_\infty$$

where $V_\infty$ is the ambient wind speed and A' is a constant computed from flow conservation considerations.

To provide the same cooling capability as an aforementioned conventional evaporative cooling tower having a base diameter of about 400 feet and a height of about 500 feet, a confined vortex cooling tower, using the teachings of this invention, will have a base diameter of about 350 feet and a height of about 200 feet. Without considering the thermal buoyancy of the rising heated gaseous fluid stream through orifice 22, which adds to the vertical axial momentum, minimum ambient wind speeds of about 4½ miles per hour would be required in the case of such an evaporative tower to avoid the use of auxiliary means of introducing forced gaseous fluid streams into said chimney. A minimum ambient wind speed will be similarly required for dry towers.

It will be apparent to those skilled in the art that various modifications and variations of the invention of the preceding disclosure may be made without departing from the spirit and scope thereof. It will be understood, therefore, that the claims hereinafter set forth should be limited only by such limitations as expressly set forth therein.

We claim:

1. In an effluent discharge apparatus having a chimney, defined by sidewalls and an open mouth, positioned above a lower cavity containing portion, the improvement comprising:

at least one slot within said chimney sidewalls extending vertically from above said cavity containing portion to below said mouth of said chimney, providing means for introducing gaseous fluid streams tangentially within and with respect to said walls of said chimney to create a vortex;

a floor dividing said cavity containing portion and said chimney and defining an upper bound of said cavity containing portion, said cavity containing portion having means to receive effluent constituents and means to receive effluent removal gaseous fluid streams wherein said effluent constituents are combined with said effluent removal gaseous fluid streams; and an orifice, centrally disposed within said floor to convey said effluent containing gaseous fluid streams from said cavity containing portion to within said chimney to be exhausted from said chimney, the boundary of said orifice being configured to form a venturi shape.

2. The effluent discharge means of claim 1 wherein said orifice is bounded by an upper and lower shaped lip configured and aligned in series to form a double venturi shape.

3. The effluent discharge means of claim 2 wherein said orifice is adjustable in diameter.

4. In an effluent discharge apparatus having a chimney, defined by sidewalls and an open mouth, positioned above a lower cavity containing portion, the improvement comprising:

at least one slot within said chimney sidewalls extending vertically from above said cavity containing portion to below said mouth of said chimney, providing means of introducing gaseous fluid streams tangentially within and with respect to said sidewalls of said chimney to create a vortex;

a floor dividing said cavity containing portion and said chimney and defining an upper bound of said cavity containing portion, said cavity containing portion having means to receive effluent constituents and mean to receive effluent removal gaseous fluid stream drafts wherein said effluent constituents are combined with said effluent removal gaseous fluid streams;

an orifice centrally disposed within said floor to convey said effluent containing gaseous fluid streams from said cavity containing portion to within said chimney to be exhausted from said chimney;

an iris-type structure bounding said orifice; and means for adjusting and controlling the fluid stream flow behaviour through each said slot;

fluid stream flow behavior through said orifice being adjustable and controllable by means of said iris-type structure.

5. In a tower or other effluent discharge stack apparatus having:

a chimney defined by sidewalls;

a lower portion for the introduction of an effluent, containing heat and particulate matter, for discharge through said chimney, said chimney being disposed above said lower portion, the improvement comprising:

a plurality of vertical slots within said chimney sidewalls extending vertically substantially from above said lower portion to below the mouth of said chimney, said slots providing means for introducing gaseous fluid streams within said sidewalls of said chimney tangentially with respect to said sidewalls to create a vortex; a floor dividing said lower portion and said chimney, and defining an upper bound of a cavity within said lower portion, said cavity providing means to receive and combine effluent constituents with effluent removing gaseous fluid streams; and an orifice, the boundary of said orifice being configued to form a venturi shape, said orifice being centrally disposed within said floor to convey said combined effluent constituents and effluent removing gaseous fluid streams entrained by said vortex from said cavity of said lower portion to within said chimney to be exhausted from said chimney.

6. The apparatus of claim 5 wherein said orifice is of an adjustable nature.

7. The apparatus of claim 5 including:

a fill encompassing said lower portion cavity;

passageways through said fill to convey said effluent removing gaseous streams from outside of said fill through said fill to within said lower portion cavity;

heat transfer means located within said cavity; and means to minimize drift within said lower portion cavity.

8. The apparatus of claim 7 wherein:

said effluent removing gaseous fluid streams are ambient air conveyed from the atmosphere to said cavity by means of said passageways;

said heat transfer means includes water as a coolant and heat transfer means; and said drift minimization means include chevron mist eliminators.

9. The apparatus of claim 8 having auxiliary means to supply forced gaseous fluid streams to said slots.

10. The apparatus of claim 7 having auxiliary means to supply forced gaseous fluid streams to said slots.

11. The apparatus of claim 10 wherein said auxiliary means include:

a means of supplying forced gaseous fluid streams;

a plenum chamber encircling said tower to receive said forced gaseous fluid streams;

ducts connected with said plenum chamber to receive said forced gaseous fluid streams, said ducts encompassing said slots to provide a conduit for said gaseous fluid streams to said slots; and directional means within said slots to distribute and direct said forced gaseous fluid streams tangentially to create said vortex within said chimney.

12. The apparatus of claim 11 wherein said forced gaseous fluid stream supply means is at least one fan.

13. The apparatus of claim 11 wherein said forced gaseous fluid stream supply means is forced stack gas effluent.

14. In a cooling tower having a chimney, defined by sidewalls and an open mouth, positioned above a lower cavity providing heat transfer means encompassed by a fill, the improvement in combination comprising:

at least one slot within and through said chimney sidewalls, extending vertically from above said fill cavity to below said mouth of said chimney, providing means for introducing gaseous fluid streams tangentially within and with respect to said chimney sidewalls to create a vortex;

a floor dividing said chimney portion and said fill cavity, defining the upper bound of said cavity;

means to introduce effluent, including heat, through said fill into said fill cavity;

means to introduce cooling gaseous fluid streams through said fill into said fill cavity whereby effluent, including heat, is transferred to said cooling gaseous fluid streams;

an orifice centrally disposed within said floor to convey said cooling gaseous fluid streams containing effluent, including heat, from said fill cavity to within said chimney to be exhausted from the mouth thereof; and means to augment and adjust said gaseous fluid streams introduced within said chimney and means to augment and adjust gaseous fluid stream flow within said cavity including means for drift elimination.

* * * * *

UNITED STATES PATENT AND TRADEMARK OFFICE

CERTIFICATE OF CORRECTION

PATENT NO. : 4,397,793

DATED : August 9, 1983

INVENTOR(S) : Gerald I. Stillman and Rudolf A. Wiley

It is certified that error appears in the above—identified patent and that said Letters Patent is hereby corrected as shown below:

At Column 2, line 10, delete the comma after the word "approximately".

At Column 4, line 5, "Those" should read --These--.

At Column 8, line 18, formula:

"$(H\alpha)r_c^4+(AR^2)r_c^3+(BHR^2\alpha)r_c^2(CH^2R^2\alpha^2)r_c+(DH^3R^2\alpha^3)=0$"

should read as follows:

--$(H\alpha)r_c^4+(AR^2)r_c^3+(BHR^2\alpha)r_c^2+(CH^2R^2\alpha^2)r_c+(DH^3R^2\alpha^3)=0$--.

Signed and Sealed this

Eleventh Day of October 1983

[SEAL]

Attest:

GERALD J. MOSSINGHOFF

Attesting Officer

Commissioner of Patents and Trademarks